US007261271B1

(12) United States Patent
Buswell

(10) Patent No.: US 7,261,271 B1
(45) Date of Patent: Aug. 28, 2007

(54) FOLDING WIRE REEL CARRIER

(76) Inventor: Clifford Buswell, HC02 76914, Palmer, AK (US) 99645

( * ) Notice: Subject to any disclaimer, the term of this patent is extended or adjusted under 35 U.S.C. 154(b) by 0 days.

(21) Appl. No.: 11/701,937

(22) Filed: Feb. 3, 2007

Related U.S. Application Data

(63) Continuation of application No. 11/074,614, filed on Mar. 8, 2005, now abandoned.

(51) Int. Cl.
*F16M 11/38* (2006.01)

(52) U.S. Cl. ..... 248/431; 248/165; 242/129.7; 242/597.8

(58) Field of Classification Search ..... 242/597.8, 242/597.5, 129.7, 129.71, 129.5, 597.1; 248/165, 248/431, 166, 127, 163.1, 176.1, 188.6; 211/195, 211/196, 200, 182
See application file for complete search history.

(56) References Cited

U.S. PATENT DOCUMENTS 4,172,608 A * 10/1979 Brown, Jr. ..... 242/588
4,533,091 A * 8/1985 Knight et al. ..... 242/129.6
4,611,645 A * 9/1986 Whisnant ..... 242/129.5
4,752,047 A * 6/1988 Franks, Jr. ..... 242/129.6
4,763,865 A * 8/1988 Danner ..... 248/164
4,917,341 A * 4/1990 Pirchio ..... 248/164
5,082,121 A * 1/1992 Grubb ..... 211/33
5,577,745 A * 11/1996 Birk ..... 280/47.19
5,806,787 A * 9/1998 Schneider ..... 242/598.5
5,944,280 A * 8/1999 Dimitri ..... 242/594.2
6,086,013 A * 7/2000 Looney et al. ..... 242/594.4
6,182,920 B1 * 2/2001 Watkins ..... 242/594.4

* cited by examiner

*Primary Examiner*—Korie Chan
(74) *Attorney, Agent, or Firm*—Michael J. Tavella

(57) ABSTRACT

A device that has as simple frame that pivots at the center instead of the top. The axels are stored in the device when not needed. They are simply slipped through holes in the frame for use. Reels are placed on the outside of the frame, which makes changing reels simple and efficient. When stored, it forms a small package that be placed anywhere. When stored. The axels are held in holders formed on the frame. In this way, the axels are always kept with the device.

17 Claims, 8 Drawing Sheets

FOLDING WIRE REEL CARRIER

CROSS REFERENCE TO RELATED APPLICATIONS

This application is a continuation of application Ser. No. 11/074,614, filed Mar. 8, 2005 now abandoned.

BACKGROUND OF THE INVENTION

1. Field of the invention

This invention relates wire reel carriers and particularly to folding wire reel carriers.

2. Description of the Prior Art

The installation of electrical system sin buildings and some residences typically involves pulling large quantities of wire through. conduits and other raceways. In such a job, groups of different colored wires are pulled simultaneously through the various conduits. For example, a typical circuit for power receptacles involves pulling black, white, green and sometimes red wires through conduits between junction boxes. Many other wire and coloring schemes can be used as well.

Professional electricians keep these wires on reels. These reels can vary in size, but are typically less than one foot in diameter. The reels have a center hole that allows the reels to be placed on some type of axel so that as wires are pulled off the reel, the reel is free to turn. Many electricians build stands for these reels out of scrap lumber. Lengths of scrap conduit are used for the axels and the reels are strung on these conduits, which are then held by the lumber frames.

Although these simple reels can work, they tend to be built shabbily and do not hold up. Inventors have produced commercial type designs for such stands. Some examples of these are found in the following U.S. Patents. U.S. Pat. No. 6,182,920, which discloses a device mounted on wheels that can hold many reels. This device is large and does not fold for storage. U.S. Pat. No. 4,611,645 teaches another device that can hold several reels. This device has a long front arm that can fold back for storage. A wheel is mounted on the arm so that the carrier can be wheeled about from job to job. U.S. Pat. No. 5,577,745 disclosed a modified hand truck. This device has a frame attached that can fold out to carry reels of wire. The frame can be folded back to move the reels from job to job. U.S. Pat. No. 5,944,280 teaches a basket type carrier that can hold a number of reels. The basket has a top handle that is used to carry to the basket around.

Several smaller carriers have been designed. These often take an "A" frame style Design that can fold for storage. U.S. Pat. No. 4,172,608 teaches a carrier that has a flat rectangular frame. Two vertical arms are foldably attached to the frame. The arms are raised into a vertical position for use. An axel with wire reels can then be secured in the arms and the wire can be pulled. When folded, a handle allows the frame to be carried. The frame has a storage compartment that holds the axel when it is not in use. U.S. Pat. No. 6,086,013 teaches an "A" frame device that has two frame that are pivotably attached at the top. The unit has clips that hold the axels, which are locked using pins.

U.S. Pat. No. 5,806,787 teaches an "A" frame device that has one axel mounted in the top using brackets and pins. Additional axels are held using bushings that has rotating heads. The axels, which have spaced holes in them, are slipped over the bushings. The heads are then turned and the axels are locked in place.

U.S. Pat. No. 4,752,047 teaches a small frame that is designed to hold one line of reels. The axel is held in place by spring clips mounted on the top brackets.

All of the small, portable patents have the reels placed on an axel that sits between the sides of the frame. Moreover, although they can fold, they are still rather large frames. Some do not store the axels on the device when folded. Finally, they all have complex locking systems that require tools and or many steps to assemble the frame for use.

BRIEF DESCRIPTION OF THE INVENTION

The instant invention overcomes all of these problems. It is a device that has as simple frame that pivots at the center instead of the top. The axels are stored in the device when not needed. They are simply slipped through holes in the frame for use. Reels are placed on the outside of the frame, which makes changing reels simple and efficient. When stored, it forms a small package that be placed anywhere. When stored. The axels are held in holders formed on the frame. In this way, the axels are always kept with the device.

DETAILED DESCRIPTION OF THE INVENTION

Figure 1:
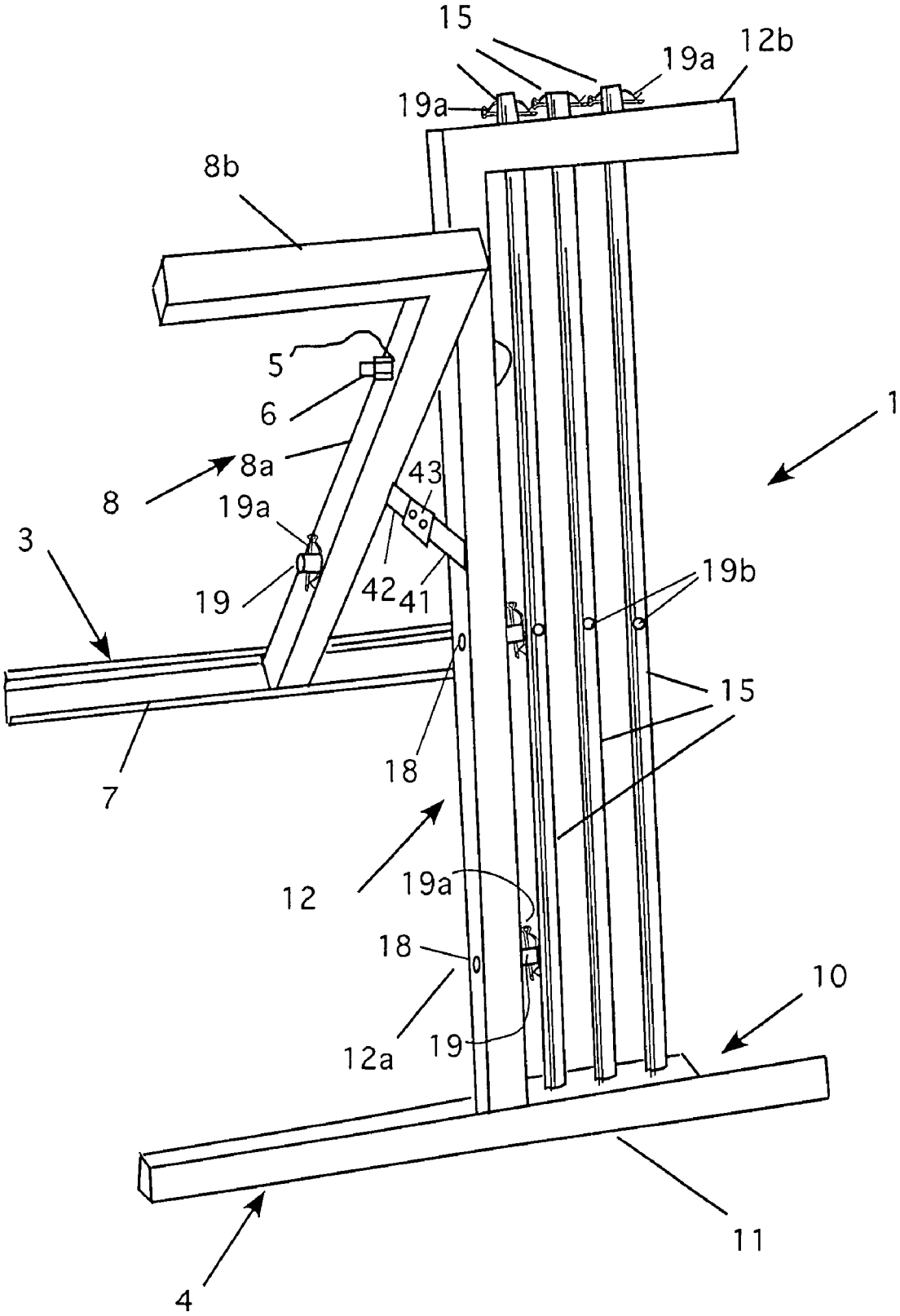
FIG. 1 is a front perspective view of a first embodiment of the invention, showing the axels in the stored position.

Referring now to FIG. 1, a front perspective view of a first embodiment of the invention 1, with the axels in the stored position is shown. The invention 1 has a stand made of two members 3 and 4 that are connected at a pivot point 5 by a fastener 6. The fastener 6 can be a nut and bolt combination or a rivet or similar fastener. The rear member 3 has a foot member 7 that supports the unit on a flat surface. Extending up from the foot is the vertical support 8, which is a tubular member that is angled at the top. Thus, the vertical member has a riser portion 8*a* and a top angled portion 8*b*.

The front member 10 has a foot member 11 that helps to further support the unit on a flat surface. Extending up from the foot 11 is the vertical support 12, which is a tubular member that is angled at the top like the rear member. The front vertical member 12 has a riser portion 12*a* and a top angled portion 12*b*.

Figure 4:
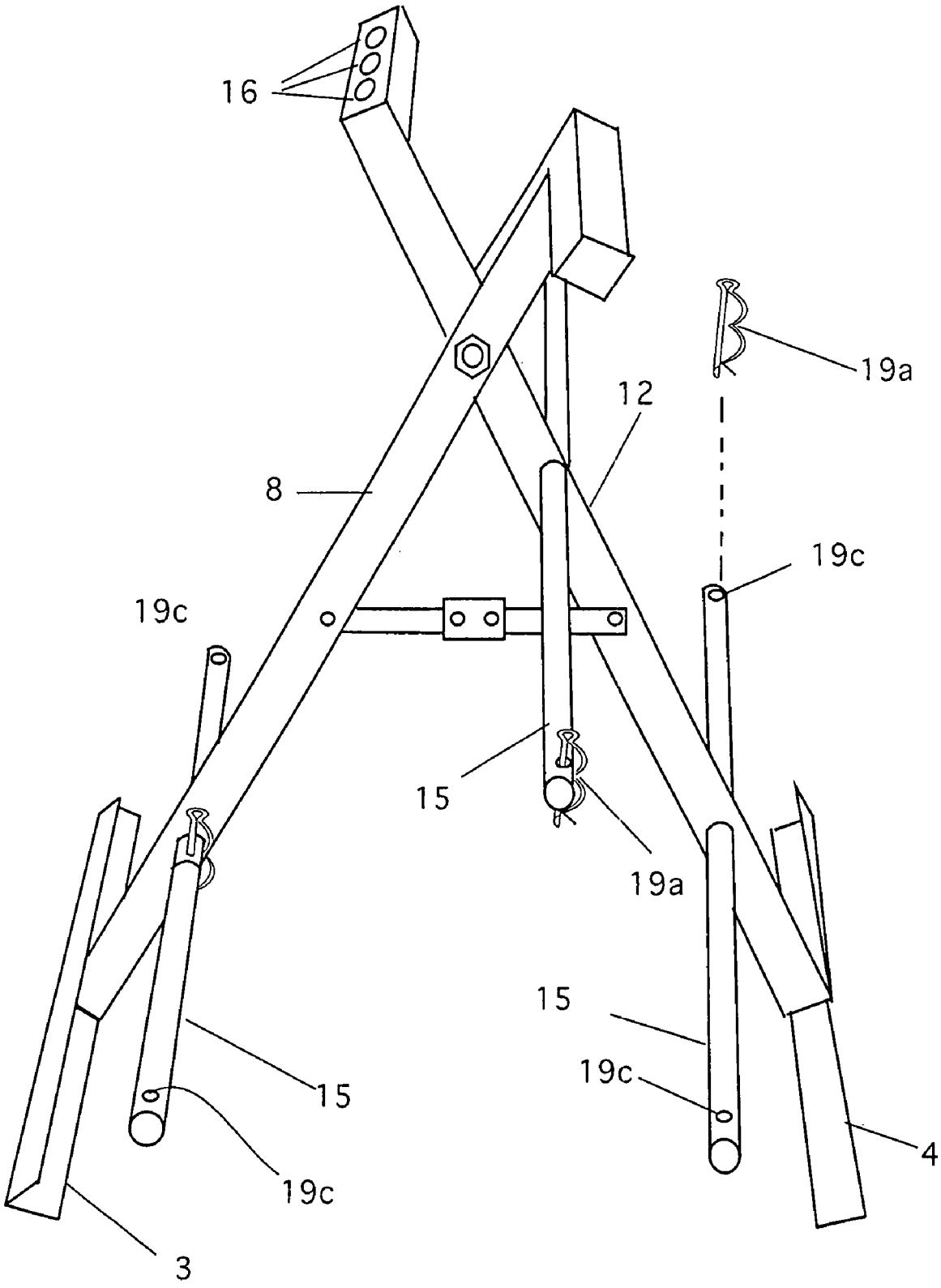
FIG. 4 is a left side perspective view of the first embodiment of the invention, showing the axels in the operating position.
Figure 5:
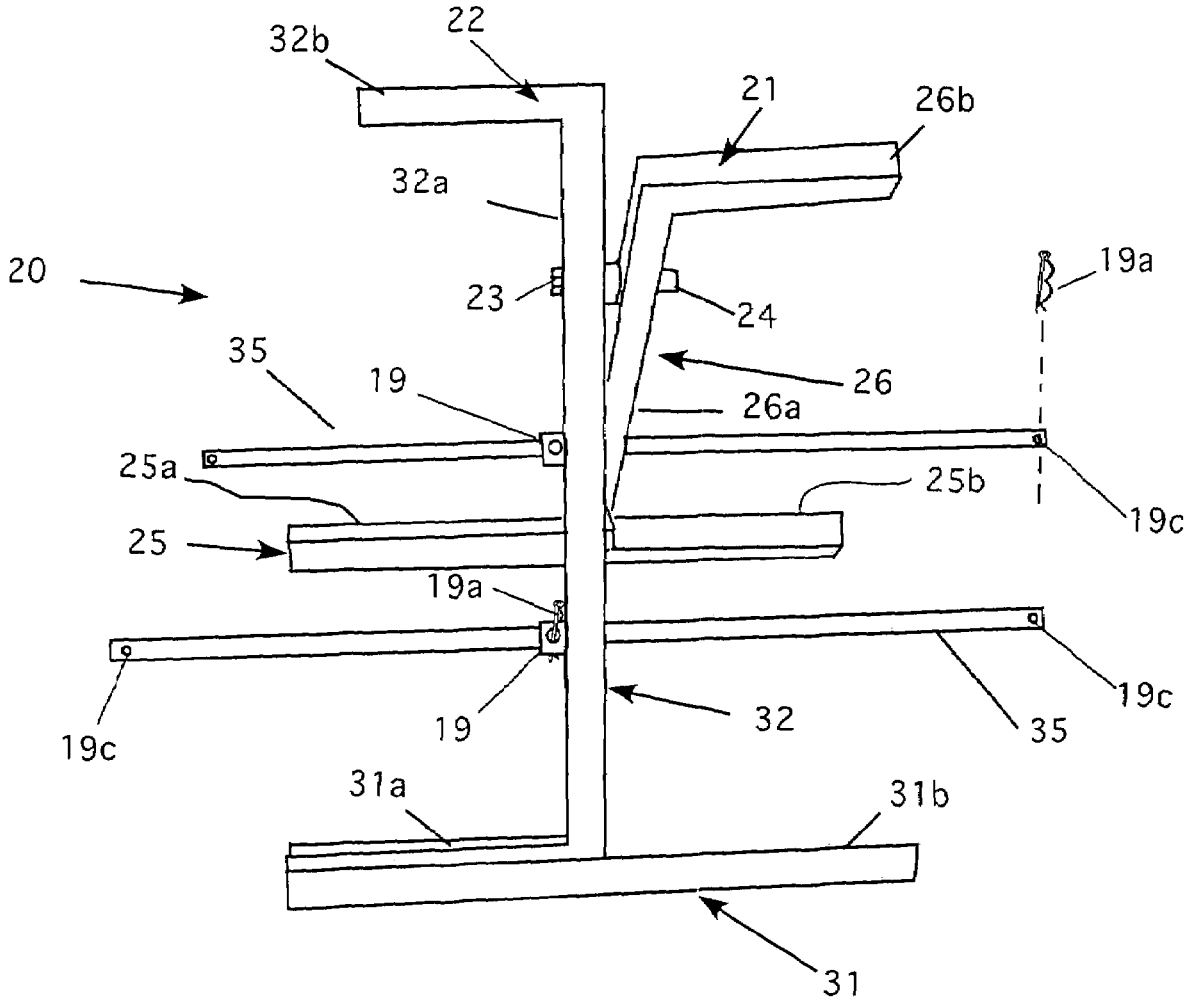
FIG. 5 is a front perspective view of a second embodiment of the invention, showing the axels in the operating position.

Three axels 15 are provided to support cable reels (FIGS. 4 and 5 show the axels deployed). FIG. 1 shows the axels 15 in the stored position. Holes 16 (see FIG. 4), provided in the top angled portion 12*b*, allow the axels 15 to be held between the top angled portion 12*b* and the foot 11 as shown. Once the axels are stored, the unit can be easily folded for storage (see FIG. 8) or moving from one location to another.

FIG. 1 also shows a locking system that consists of two pivot arms 41 and 42 that are attached to the front and rear members by fasteners that allow the arms to pivot. A locking bar 43 is secured to the pivoting arms. The locking bar is used to lock the pivot arms in position for use. This locking system is similar to those found on stepladders and is well known in the art.

The axels 15 are held in the frame by passing them through holes 17 and 18 that are drilled in the frame. Each of the holes 17 and 18 has a bushing 19 that extends out from the frame as shown. Each of the bushings 19 has holes drilled in them to receive pins 19*a*. The axels 15 have holes 19*b* that coordinate with the holes in the bushings so that when the axels are in place, the pins 19*a* pass through both the bushings and the axels, thereby securing the axels in place for use.

The axels also have holes 19*c* for pins 19*a* that hold the wire reels on the axels in use. See FIG. 4.

Figure 2:
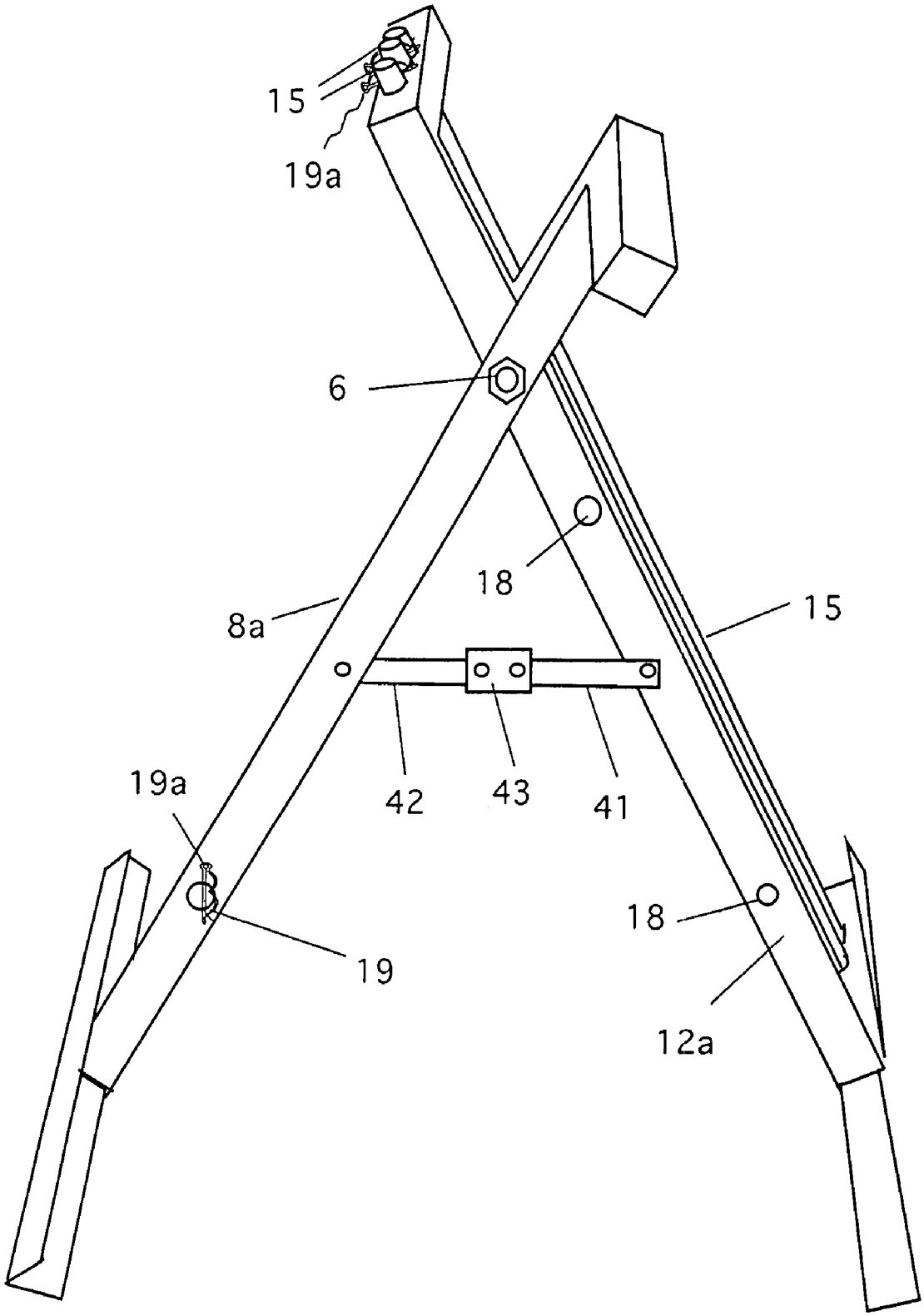
FIG. 2 is a left side perspective view of the first embodiment of the invention, showing the axels in the stored position.

FIG. 2 is a left side perspective view of the first embodiment of the invention, showing the axels 15 in the stored position. In this view, the sides of the vertical portions 8*a* and 12*a* are shown. The pivot point nut 6 is shown. Holes 17 and 18 are shown in the vertical members 8*a* and 12*a* these holes are provided to hold the axels 15 when in the deployed position (as discussed below). One bushing 19 is shown on member 8*a* (the bushings for member 12*a* are on the opposite side—of course, these placements can be rotated, if desired). Pins 19*a* are shown in the axels 15.

Figure 3:
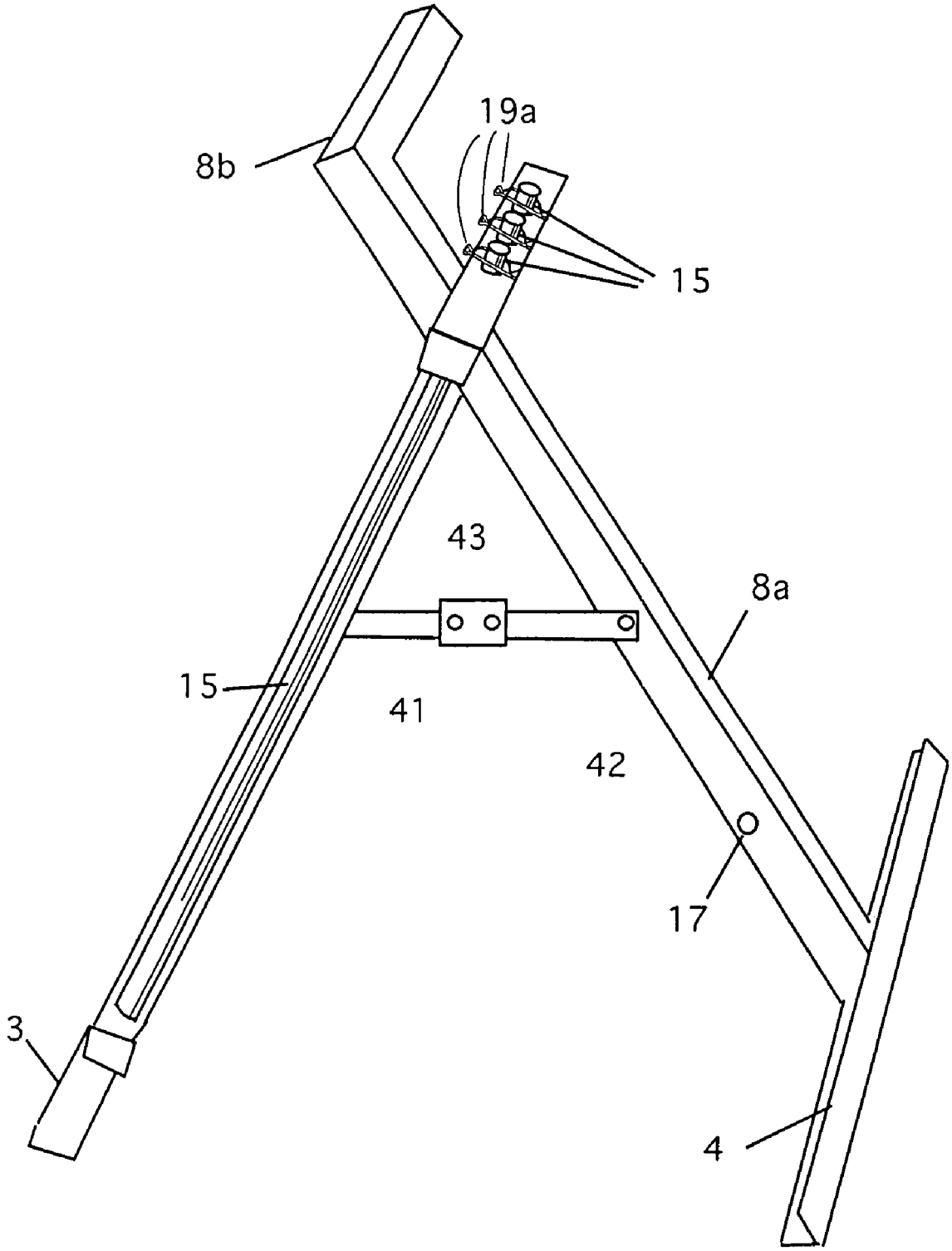
FIG. 3 is a right side perspective view of the first embodiment of the invention, showing the axels in the stored position.

FIG. 3 is a right side perspective view of the first embodiment of the invention, showing the axels in the stored position from the opposite side of the unit. Hole 17 is shown in the vertical member 8*a*.

FIG. 4 is a left side perspective view of the first embodiment of the invention, showing the axels in the operating position. Here, the axels 15 are shown in position in for use. The axels pass through the holes 17 and 18. The storage holes 16 are clearly shown in the figure. Here, the pins 19*a* are shown in the bushing 19 and in hole 19*c* of one of the axels. A pin 19*a* is shown in alignment with a hole 19*c* in one of the axels. Of course, in operation, all axels are secured to the frame with pins. In addition, the pins 19*a* are not placed in the holes 19*c* until after the wire reels (not shown) are in place on the axels.

FIG. 5 is a front perspective view of a second embodiment of the invention, showing the axels in the operating position. This embodiment 20 has a stand made of two members 21 and 22 that are connected at a pivot point 23 by a fastener 24. The fastener 24 can be a nut and bolt combination or a rivet or similar fastener. The rear member 21 has a foot member 25 that supports the unit on a flat surface. Extending up from the foot is the vertical support 26, which is a tubular member that is angled at the top. Thus, the vertical member has a riser portion 26*a* and a top angled portion 26*b*.

The front member 30 has a foot member 31 that helps to further support the unit on a flat surface. Extending up from the foot 31 is the vertical support 32, which is a tubular member that is angled at the top like the rear member. The front vertical member 32 has a riser portion 32*a* and a top angled portion 32*b*.

Unlike the first embodiment the feet 25 and 31 of this embodiment are made up of a tubular portion 25*a* and 31*a* and an angled portion 25*b* and 31*b*. The tubular portions are aligned opposite the angled portions. Thus, portion 25*a* is opposite the angled portion 31*b* and vice versa. This is done so that when the unit is folded, the tubular member lies within the angled member, thereby making a more compact unit when the unit is folded.

FIG. 5 also shows the axels 35 in place. This embodiment shown only two axels, however, more can be added by changing the size of the device. As before, the axels 35 are secured in the frame with the bushings 19 and pins 19*a* through holes 19*b* in the axels (see FIG. 1). In addition, the holes 19*c* are shown in the axels for pins 19*a* to secure the wire reels when they are in place.

Figure 6:
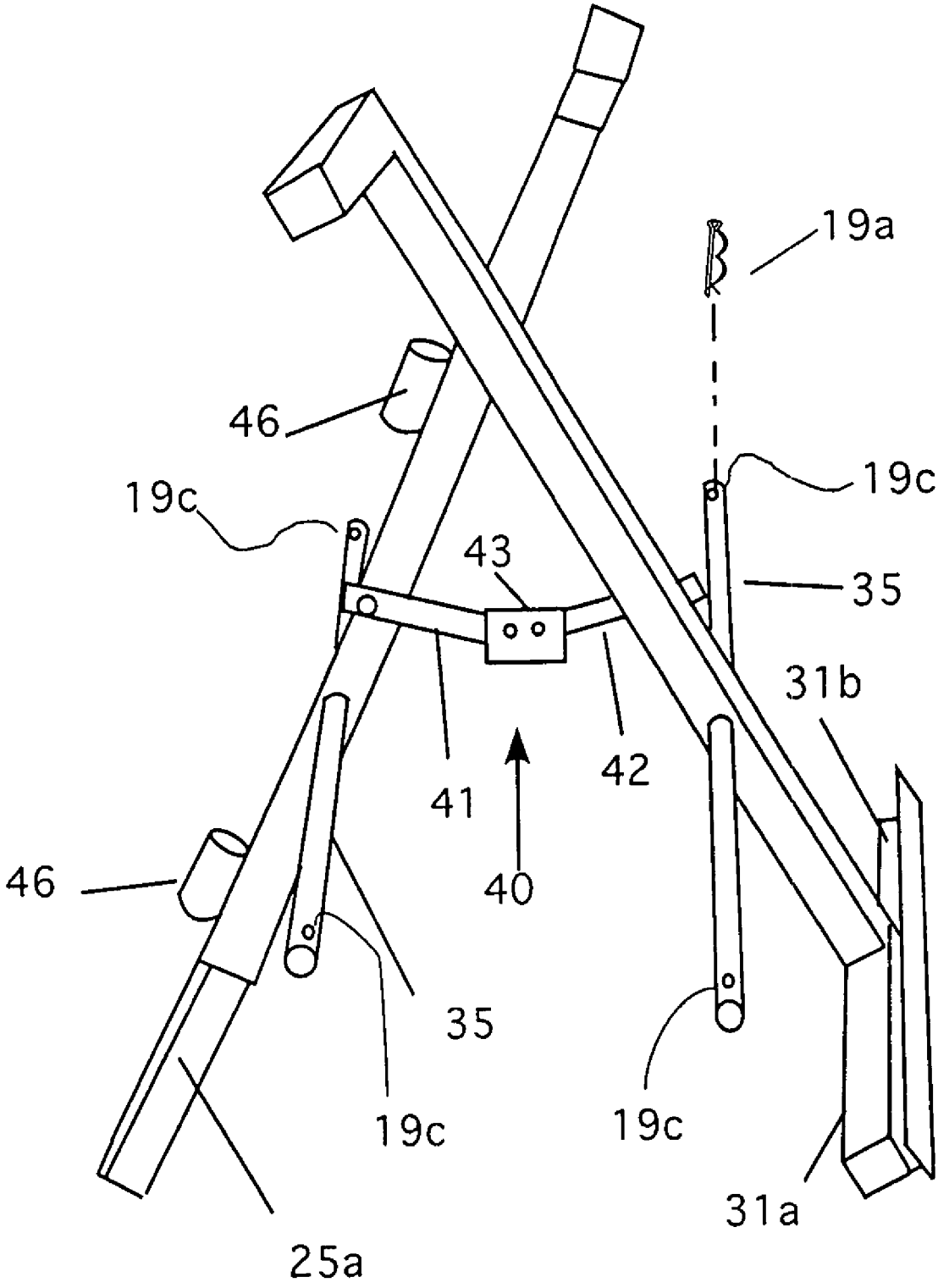
FIG. 6 is a left side view of the second embodiment of the invention, showing the axels in the operating position.

FIG. 6 is a left side view of the second embodiment of the invention, showing the axels 35 in the operating position. Here, the structure of the device is similar to that of the first embodiment. Note the bushings 19, the pins 19*a* and the holes 19*c* as before.

Here, a locking system 40 is shown. The locking system (which can be used on the first embodiment as well) consists of two pivot arms 41 and 42 that are attached to the front and rear members by fasteners that allow the arms to pivot. A locking bar 43. is secured to the pivoting arms. The locking bar is used to lock the pivot arms in position for use. This locking system is similar to those found on stepladders and is well known in the art. FIG. 6 also shows two storage cylinders 46 in which the axels are held when stored. See also, FIG. 7.

Figure 7:
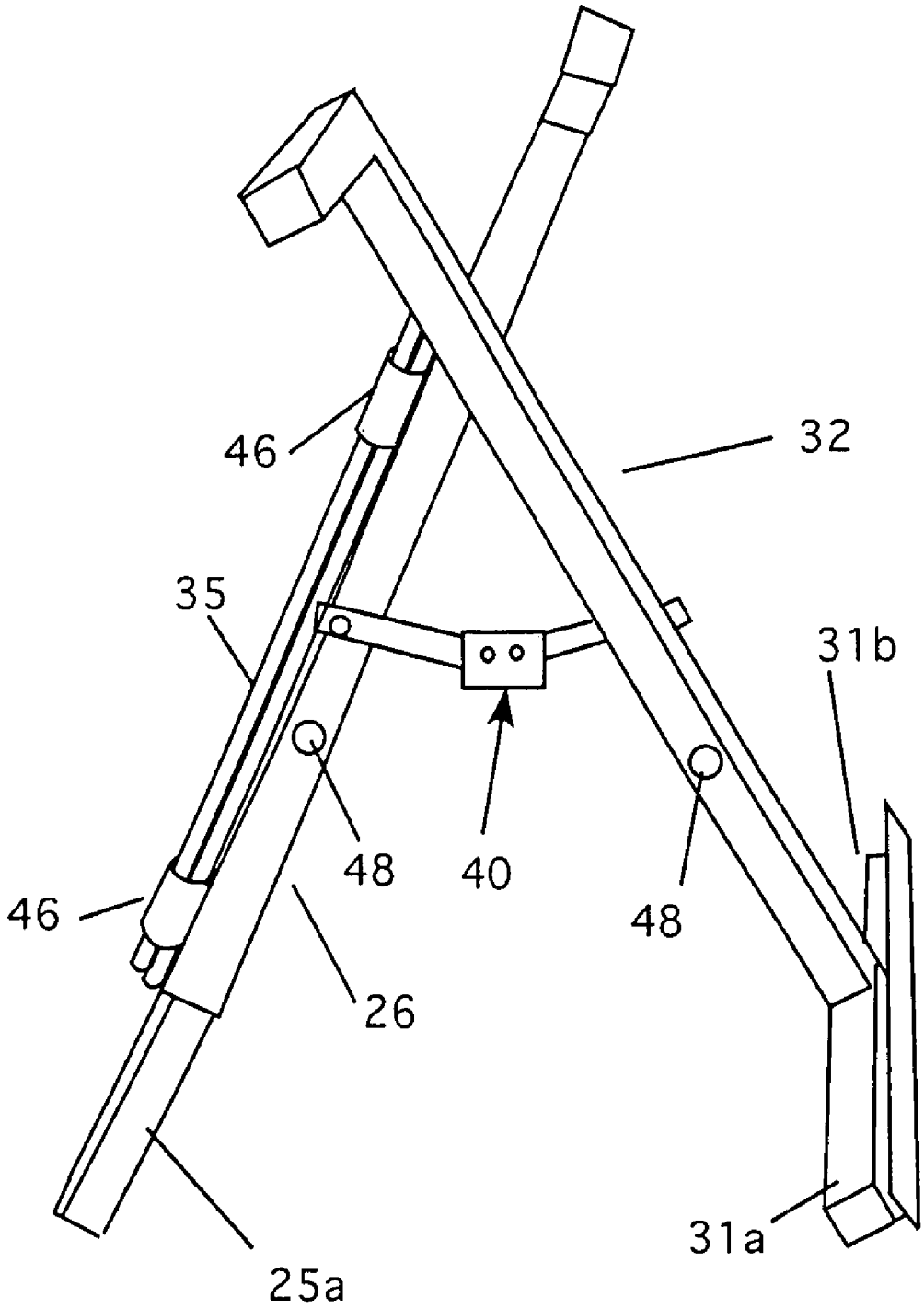
FIG. 7 is a left side view of the second embodiment of the invention, showing the axels in the stored position.

FIG. 7 is a left side view of the second embodiment of the invention, showing the axels in the stored position. In this figure, the axels 35 are positioned in the two storage cylinders 46. Bushings 19 are shown on the front and rear members. These holes hold the axels when they are deployed for use.

Figure 8:
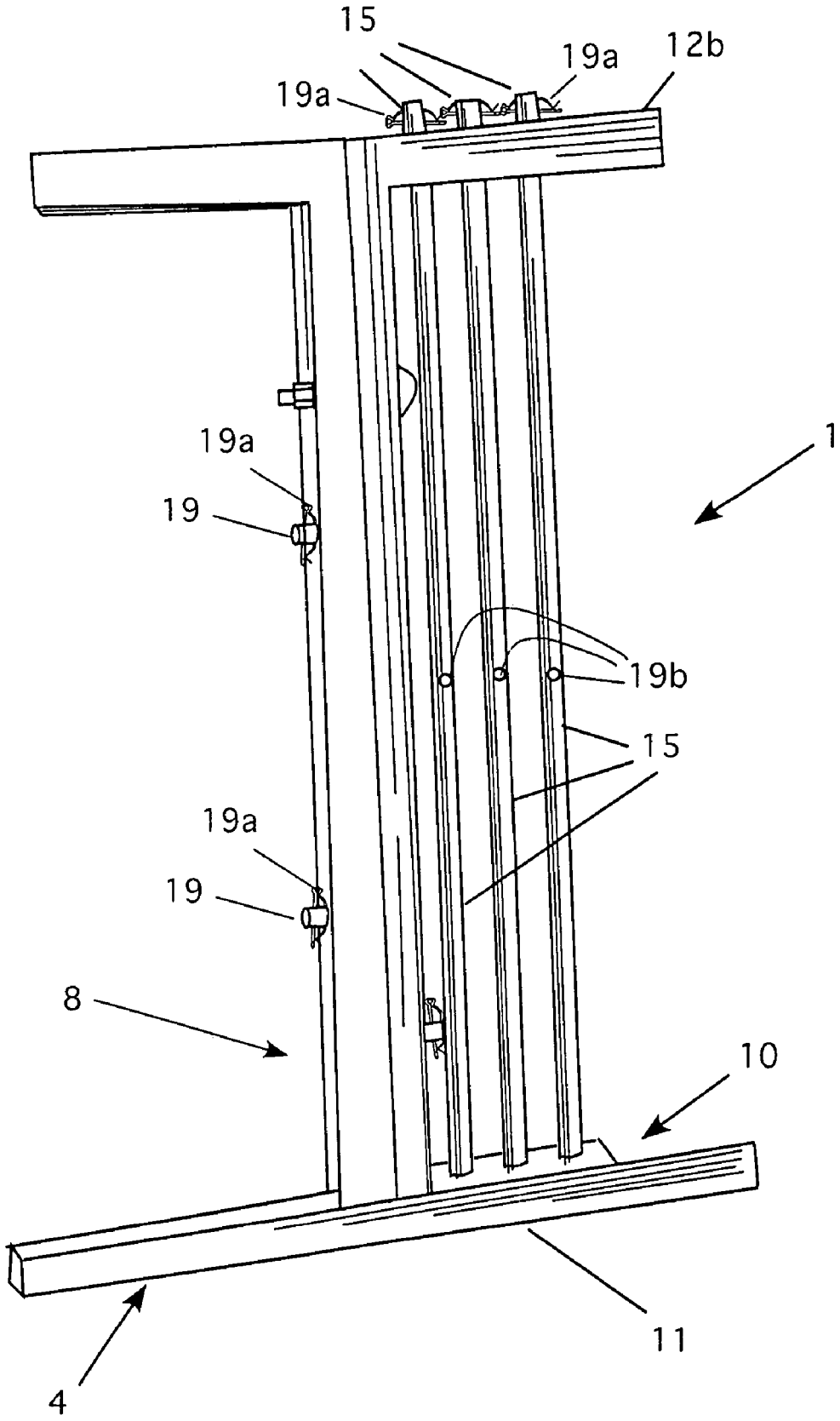
FIG. 8 is a perspective view of the first embodiment shown in the folded position for storage.

FIG. 8 shows the first embodiment 1 in the folded position. Note that the second embodiment folds in a similar manner. Here, the base of the rear member 8 is pivoted forward until in meets the base 4 of the front member. In this position, the two vertical members are in alignment ant the top members for a "tee". In this configuration, the device forms a compact unit easily storable in a variety of locations or easily movable to a jobsite location.

In the preferred embodiment the device is made of a lightweight steel or similar material. It also can be made of high strength plastic.

The device is designed to remain small enough to be carried by workers. However, it can be made considerably larger if desired.

In use, the device (either of the two embodiments) is carried to the desired location. The front and rear members are opened and locked into place. The axels are then removed from their holders and are positioned in the holes in the frame. Wire reels are then positioned on the axels as desired. Reels should be placed on both sides of the unit to maintain balance. Wire can then be pulled from one or more of the reels as needed for the task. The unit may be transported to another area with the reels still in place or the reels can be removed the unit folded for transport or for storage.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A folding wire reel carrier comprising:

a) a front support member, having a base portion, a vertical portion, and horizontal top portion disposed at a topmost end of the vertical portion b) a rear support member, also having a base portion, a vertical portion, and a horizontal top portion disposed at a topmost end of the vertical portion, said rear support member being pivotably attached to said front support member such that the vertical portion of the front support member is adjacent to the vertical portion of the rear support member;

c) a first means for operably holding a wire reel carrying axel formed in said vertical portion of said front support member below said horizontal top portion, and a second means for operably holding a wire reel carrying axel formed in said vertical portion of said rear support member below said horizontal top portion; and d) at least one wire reel carrying axel removably installed in one of said first and second means for operably holding a wire reel carrying axel, said at least one wire reel carrying axel having two ends and a center portion and being positioned such that said center portion of said at least one wire reel carrying axel is held within said one of said first and second means for operably holding a wire reel carrying axel, and further such that the two ends of said at least one wire reel carrying axel extend outward from the vertical portions of the front and rear support members.

2. The folding wire reel carrier of claim 1 wherein the first means for operably holding a wire reel carrying axel formed in said front support member comprises a hole formed in said vertical portion of said front support member comprises a hole formed in said vertical portion of said front support member.

3. The folding wire reel carrier of claim 1 wherein the first means for operably holding a wire reel carrying axel formed in said vertical portion of said front support member comprises a pair of space-apart holes formed in said vertical portion of said front support member.

4. The folding wire reel carrier of claim 1 wherein the second means for operably holding a wire reel carrying axel formed in said vertical portion of said rear support member comprises a hole formed in said vertical portion of said rear support member.

5. The folding wire reel carrier of claim 3 further comprising a pair of wire reel carrying axels, removably installed in said pair of spaced-apart holes formed in said vertical portion of said front support member.

6. The folding wire reel carrier of claim 1 further comprising a means for storing said wire reel carrying axel, formed on said wire reel carrier.

7. A folding wire reel carrier comprising:

a) a front support member, having a base portion, and a vertical portion having a center, said vertical portion having a topmost end and a bottom end, and a top horizontal portion disposed at said topmost end of the vertical portion;

b) a rear support member, also having a base portion, a vertical portion having a center, said vertical portion having a topmost end and a bottom end, and a top horizontal portion disposed at said topmost end of the vertical portion, said vertical portion of said rear support member being pivotably attached to said vertical portion of said front support member by a pivot means located intermediate of the two ends of the vertical portions of the front support member and the rear support member and above the center of said vertical portions;

c) a first means for operably holding a wire reel carrying axel formed in said front support member and a second means for operably holding a wire reel carrying axel formed in said rear support members;

d) at least one wire reel carrying axel removably installed in one of said first and second means for operably holding a wire reel carrying axel, said at least one wire reel carrying axel having two ends and a center portion and being positioned such that said center portion of said at least one wire reel carrying axel is held within said one of said first and second means for operably holding a wire reel carrying axel, and further such that the two ends of said at least one wire reel carrying axel extend outward from the vertical portions of the front and rear support members; and e) a means for locking the front support member and said rear support member in an open, operating position.

8. The folding wire reel carrier of claim 7 wherein the first means for operably holding a wire reel carrying axel formed in said front support member comprise:

a) a hole formed in said front support member;

b) a bushing, attached to said front support member and being in alignment with said hole in said front support member, said bushing having a pair of oppositely disposed holes therein;

c) a hole, formed in said at least one axel; and e) a removable pin, whereby when said at least one axel is placed in said bushing, the hole in said axel aligns with the holes in said bushing, and further wherein said removable pin is placed within said holes in said bushing and said at least one axel, thereby securing said axel in said bushing.

9. The folding wire reel carrier of claim 7 wherein the first means for operably holding a wire reel carrying axel formed in said front support member. comprise:

a) a pair of spaced-apart holes formed in said front support member, wherein each of said spaced apart holes has a bushing, attached to said front support member and being in alignment with said hole in said front support member, said bushings having a pair of oppositely disposed holes therein;

c) a hole, formed in said at least one axel; and e) a removable pin, whereby when said at least one axel is placed in one of said bushings, the hole in said axel aligns with the holes in said bushing, and further wherein said removable pin is placed within said holes in said bushing and said at least one axel, thereby securing said axel in said bushing.

10. The folding wire reel carrier of claim 7 wherein the second means for operably holding a wire reel carrying axel formed in said rear support member comprises:

a) a hole formed in said rear support member;

b) a bushing, attached to said rear support member and being in alignment with said hole in said rear support member, said bushing having a pair of oppositely disposed holes therein;

c) a hole, formed in said at least one axel; and d) a removable pin, whereby when said at least one axel is placed in said bushing, the hole in said axel aligns with the holes in said bushing, and further wherein said removable pin is placed within said holes in said bushing and said at least one axel, thereby securing said axel in said bushing.

11. The folding wire reel carrier of claim 9 further comprising a pair of wire reel carrying axels, removably installed in said pair of spaced-apart holes formed in said front support member.

12. The folding wire reel carrier of claim 7 further comprising a means for storing said wire reel carrying axel, formed on said wire reel carrier.

13. The folding wire reel carrier of claim 7 wherein said at least one axel has two ends, and further the at least one axel having a hole formed adjacent to each of the two ends; and a pair of removable pins, one of said pair of pins being removably positioned in each of said holes in said at least one axel.

14. The folding wire reel carrier of claim 11 wherein each of said pair of axles has two ends, and further each of said axels has a hole formed adjacent to each of the two ends; and a pair of removable pins, one of said pair of pins being removably positioned in each of said holes in each of said pair of axles.

15. A folding wire reel carrier comprising:

a) a front support member having a bottom foot extending horizontally, and a vertical member, attached to said bottom foot and extending upwardly therefrom, said vertical member having a horizontal top member disposed at a topmost end of the vertical portion;

b) a rear support member having a bottom foot, extending horizontally, and a vertical member, attached to said bottom foot and extending upwardly therefrom said vertical member having a horizontal top member disposed at a topmost end of the vertical portion;

c) said front and rear support members being positioned such that the vertical member from said front support member abuts the vertical member of said rear support member;

d) a means for pivoting said front support member and said rear support member, said means for pivoting passing through a single point in said vertical members of said front and rear support members, said means for pivoting is disposed below the horizontal top members;

e) a first means for operably holding a wire reel carrying axel formed in said vertical member of said front support member and a second means for operably holding a wire reel carrying axel formed in said vertical member of said rear support members, said first and second means for operably holding a wire reel carrying axel being independent from said means for pivoting; and f) at least one wire reel carrying axel removably installed in one of said first and second means for operably holding a wire reel carrying axel, said at least one wire reel carrying axel having two ends and a center portion and being positioned such that said center portion of said at least one wire reel carrying axel is held within said one of said first and second means for operably holding a wire reel carrying axel, and further such that the two ends of said at least one wire reel carrying axel extend outward from a respective vertical members of the front and rear support members.

16. The folding wire reel carrier of claim 15 further comprising a first configuration wherein said folding wire reel carrier is open for use and a second configuration wherein said folding wire reel carrier is closed for storage.

17. The folding wire reel carrier of claim 15 wherein when said folding wire reel carrier is in said second configuration the bottom foot of said front support member abuts the bottom foot of said rear support member.

* * * * *